United States Patent [19]

Jacinto

[11] 4,305,675

[45] Dec. 15, 1981

[54] FILE FASTENER

[76] Inventor: Roberto A. Jacinto, #93 10th Ave., New Manila, Quezon City, Philippines

[21] Appl. No.: 59,254

[22] Filed: Jul. 19, 1979

[51] Int. Cl.[3] ..... B42F 13/10; B42F 13/02

[52] U.S. Cl. ..... 402/61; 402/62; 402/63; 402/15; 402/80 P; 402/68

[58] Field of Search ..... 402/8, 13, 14, 15, 17, 402/60, 61, 62, 63, 64, 68, 80 P

[56] References Cited

U.S. PATENT DOCUMENTS 2,184,276 12/1939 Brennan ..... 402/22 X
4,121,892 10/1978 Ness ..... 402/17

FOREIGN PATENT DOCUMENTS 260057 7/1965 Australia ..... 402/15
1368407 9/1974 United Kingdom ..... 402/15

*Primary Examiner*—Paul A. Bell

[57] ABSTRACT

The file fastener of this invention consists of a presser member having an elongated cavity, opposed transverse slots at the ends of said cavity and means provided in said elongated cavity and on the opposed outer portions of the male member, which means causes the locking of said outer portions in the cavity when said opposed outer end portions are fitted horizontally and on top of each other within the cavity of the presser member. A cover is slidably fitted on the upper side of the presser member to retain the opposed outer portions of the male strap within the cavity of the presser member.

1 Claim, 4 Drawing Figures

FILE FASTENER

PRIOR ART

Previous file fasteners are made of sheet metal consisting of a strip or male member having a pair of opposed outer end portions which are inserted into the opposed slots of the female or presser member which is provided with a pair of slidable straps for retaining the outer end portions horizontally flat on the presser member.

Other sheet metal file fasteners use a hinged and slidable cover for retaining the opposed outer end portions of the male member horizontally flat on the female or presser member. These type have the covers hingedly connected to the longitudinal side of the female member.

THE INVENTION

This invention relates particularly to a file fastener having means in the male and female members thereof which are adapted to engage each other to prevent the opposed end portions of the male from sliding off the female member after said end portions are bent horizontally flat one on top of the other within an elongated cavity provided in the female member.

DRAWINGS

FIG. 1 of the drawings is an exploded view of one embodiment of the file fastener in accordance with this invention.

FIG. 2 is a fragmentary view showing the end portions of the female member fitted in the cavity of the female member.

FIG. 3 of the drawings is an exploded view of another embodiment of the file fastener.

FIG. 4 is also a fragmentary view showing the end portion of the male member fitted in the cavity of the female member.

DETAILED DESCRIPTION OF THE DRAWINGS

Figure 1:
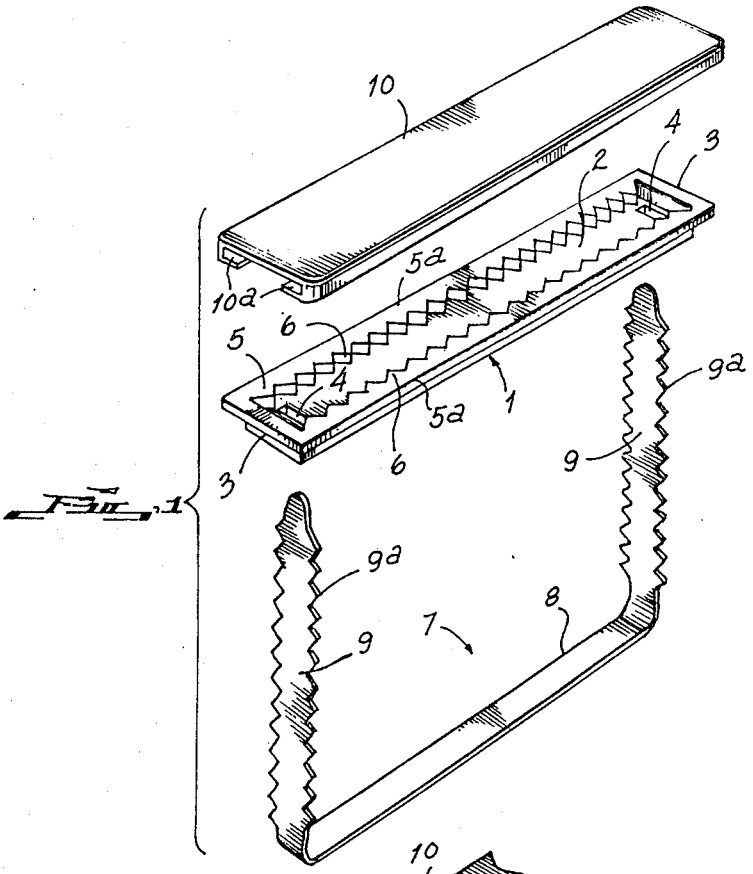
Figure 2:
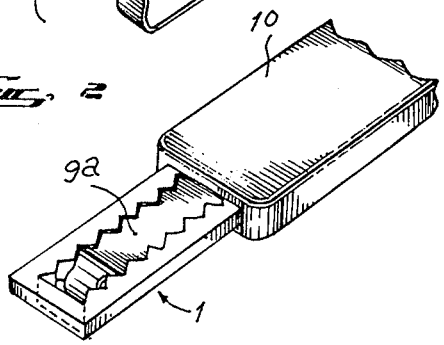

Referring now to the drawings, particularly FIGS. 1 and 2, this file fastener in accordance with this invention consists of a female member 1 having a longitudinal cavity 2 terminating substantially close to the opposed transverse ends 3 thereof, transverse slots 4 at the opposed ends of the cavity and a peripheral flange 5. The cavity has opposed serrated sides 6.

Cooperating with the female member 1 is the male member 7 which has a plain middle portion 8 and outer portions 9 with serrations 9*a* at the sides thereof. The serrated outer portions are adapted to be inserted through holes provided on the file of papers (not shown) to be fastened together and through the transverse slots 4 then bent downwardly flat into the cavity 2 so that the serrations of said outer portions would fit into the serrations of the cavity. Once the opposed outer end portions of the male members are fitted in the cavity of the female member one on top of each other, said outer portions could not anymore be pulled out of the female member thereby assuring a tight and loose-proof compilation of the papers to be fastened together.

Slidably fitted to the female member 1 is the cover member 10 which has a pair of opposed longitudinal grooves 10*a* adapted to slidably engage longitudinal sides 5*a* of the peripheral flange 5. The cover is coextensive as the female member, thus completely covering the upper side thereof.

Figure 3:
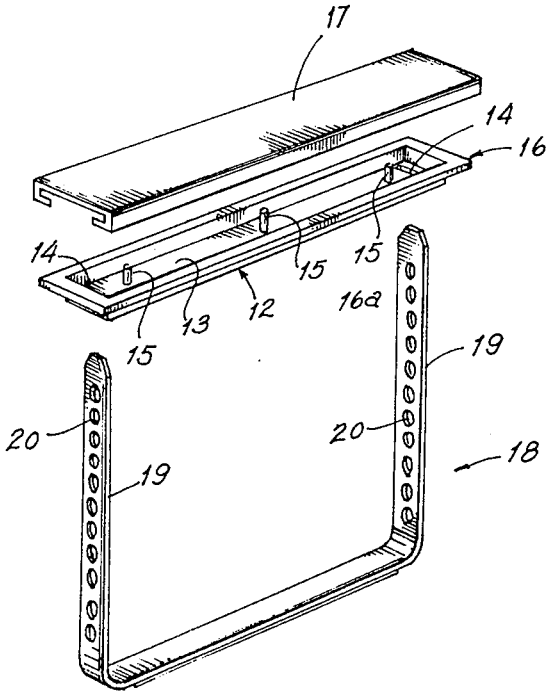
Figure 4:
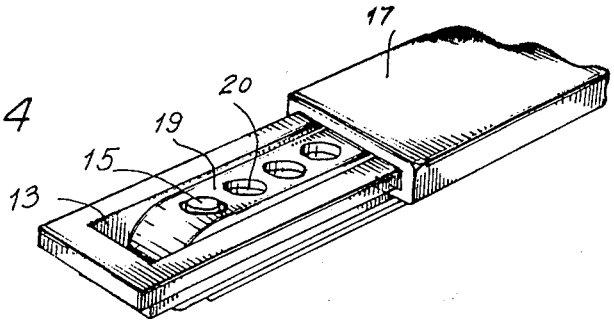

The other embodiment, shown in FIGS. 3 and 4 has a female member 12 also with a longitudinal cavity 13, opposed transverse slots 14 at the opposed ends of said cavity several spaced apart round lugs 15 extending substantially to the upper side of the female member, and also a peripheral flange 16 on the longitudinal sides 16*a* of which is slidably fitted the cover 17 of similar construction as the earlier mentioned embodiment.

The male member 18 of this embodiment has outer end portions 19 provided with a plurality of spaced apart circular slots 20 which are adapted to fit onto the lugs 15 when said outer end portions are bent horizontally flat in the cavity of the female member.

The center to center distance between the rounded lugs is equal to the center to center distance between corresponding spaced apart circular seats.

For the two embodiments described, it is understood that the depth of the cavity of the female member is slightly larger than the thickness of the outer end portions of the male member when these are bent horizontally flat one on top of the other in said cavity.

The parts of this file fastener are made of molded plastics.

Various modifications maybe made on the specific embodiments described above without departing from the essence of the invention as defined in the appended claims.

I claim:

1. A file fastener comprising a female member having a peripheral flange at the top side thereof, a longitudinal cavity with serrations on the longitudinal sides thereof, and a transverse slot at each of the opposed ends of said cavity; and a male member having an intermediate portion and a pair of identical outer portions insertable through said transverse slots of said female members and bendable in horizontally flat manner in said longitudinally cavity of said female member, said outer portions of said male member having corresponding serrations which mesh with said serrations on the longitudinal sides of the cavity of said female member when said outer portions are bent horizontally in said cavity, and a cover member slidably disposed on the longitudinal sides of said peripheral flange.

* * * * *